US010848894B2

(12) United States Patent
Laaksonen et al.

(10) Patent No.: US 10,848,894 B2
(45) Date of Patent: Nov. 24, 2020

(54) CONTROLLING AUDIO IN MULTI-VIEWPOINT OMNIDIRECTIONAL CONTENT

(71) Applicant: Nokia Technologies Oy, Espoo (FI)

(72) Inventors: Lasse Juhani Laaksonen, Tampere (FI); Sujeet Shyamsundar Mate, Tampere (FI); Kari Juhani Jarvinen, Vantaa (FI)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 15/948,362

(22) Filed: Apr. 9, 2018

(65) Prior Publication Data

US 2019/0313199 A1 Oct. 10, 2019

(51) Int. Cl.

| | |
|---|---|
| ***H04R 5/02*** | (2006.01) |
| ***H04S 7/00*** | (2006.01) |
| ***H04S 3/00*** | (2006.01) |

(52) U.S. Cl.

CPC ..... *H04S 7/303* (2013.01); *H04S 3/008* (2013.01); *H04S 2400/11* (2013.01); *H04S 2420/11* (2013.01)

(58) Field of Classification Search

CPC ..... H04S 7/303; H04S 3/008; H04S 2400/11; H04S 2420/11

USPC ..... 381/303, 310

See application file for complete search history.

(56) References Cited

U.S. PATENT DOCUMENTS

| | | | | |
|---|---|---|---|---|
| 5,993,318 | A | 11/1999 | Kousaki | |
| 8,078,300 | B2 | 12/2011 | Takagi et al. | |
| 9,087,403 | B2 | 7/2015 | Keating et al. | |
| 2011/0040395 | A1* | 2/2011 | Kraemer | G10L 19/00 700/94 |
| 2012/0106753 | A1* | 5/2012 | Theverapperuma | H04R 3/005 381/92 |
| 2014/0119581 | A1* | 5/2014 | Tsingos | H04S 5/00 381/300 |
| 2014/0328505 | A1 | 11/2014 | Heinemann et al. | |
| 2016/0119659 | A1 | 4/2016 | Hunt et al. | |

(Continued)

FOREIGN PATENT DOCUMENTS

| | | | |
|---|---|---|---|
| EP | 1565035 | A2 | 8/2005 |
| WO | 2009128859 | A1 | 10/2009 |

OTHER PUBLICATIONS

"Google Lets You Listen to 3D Virtual Reality Audio in Your Headphones", https://www.popsci.com/google-gives-new-spatial-vr-audio-omnitone, 2 pgs, Jul. 25, 2016.

*Primary Examiner* — Ammar T Hamid
(74) *Attorney, Agent, or Firm* — Harrington & Smith

(57) ABSTRACT

A method is provided including determining a first listening point of a user in an audio space, wherein the audio space comprises at least the first listening point and a second listening point; rendering audio associated with at least one first audio object of the first listening point based on a position and/or orientation of the user relative to the first listening point; in response to receiving an indication of a switch from the first listening point to a second listening point, controlling the rendering of the audio based at least on signaling associated with at least the first audio object, wherein the signaling comprises one or more conditions indicating whether playback of the first audio object is to continue during and/or after the switch to the second listening point.

22 Claims, 6 Drawing Sheets

(56) References Cited

U.S. PATENT DOCUMENTS

| | | | | |
|---|---|---|---|---|
| 2017/0165575 | A1* | 6/2017 | Ridihalgh | A63F 13/54 |
| 2017/0230760 | A1 | 8/2017 | Sanger et al. | |
| 2018/0098173 | A1* | 4/2018 | van Brandenburg | H04S 7/303 |
| 2018/0206057 | A1* | 7/2018 | Kim | G10L 19/008 |

* cited by examiner

CONTROLLING AUDIO IN MULTI-VIEWPOINT OMNIDIRECTIONAL CONTENT

TECHNICAL FIELD

Various example embodiments relate generally to audio rendering and, more specifically, relate to immersive audio content signaling and rendering.

BACKGROUND

Immersive audio and/or visual content generally allows a user to experience the content in a manner consistent the user's orientation and/or location. For example, immersive audio content may allow a user to experience audio in a manner consistent with the user's rotational movement (e.g. pitch, yaw, and roll). This type of immersive audio is generally referred to as 3DoF (three degrees of freedom) content. Immersive content with full degree of freedom for roll, pitch and yaw, but limited freedom for translation movements is generally referred to as 3DoF+. Free-viewpoint audio (which may also be referred to as 6DoF) generally allows for a user to move around in an audio (or generally, audio-visual or mediated reality) space and experience the audio space in a manner that correctly corresponds to his location and orientation in it. Immersive audio and visual content generally have properties such as a position and/or alignment in the mediated content environment to allow this.

The Moving Picture Experts Group (MPEG) is currently standardizing immersive media technologies under the name MPEG-I, which includes methods for various virtual reality (VR), augmented reality (AR) and/or mixed reality (MR) use cases. Additionally, the 3rd Generation Partnership Project (3GPP) is studying immersive audio-visual services for standardization, such as for multi-viewpoint streaming of VR (e.g., 3DoF) content delivery.

Abbreviations that may be found in the specification and/or the drawing figures are defined below, after the main part of the detailed description section.

BRIEF SUMMARY

This section is intended to include examples and is not intended to be limiting.

In an example embodiment, a method is provided including: determining a first listening point of a user in an audio space, wherein the audio space comprises at least the first listening point and a second listening point; rendering audio associated with at least one first audio object of the first listening point based on a position and/or orientation of the user relative to the first listening point; in response to receiving an indication of a switch from the first listening point to a second listening point, controlling the rendering of the audio based at least on signaling associated with at least the first audio object, wherein the signaling comprises one or more conditions indicating whether playback of the first audio object is to continue during and/or after the switch to the second listening point.

In an example embodiment, an apparatus is provided comprising: means for determining a first listening point of a user in an audio space, wherein the audio space comprises at least the first listening point and a second listening point; means for rendering audio associated with at least one first audio object of the first listening point based on a position and/or orientation of the user relative to the first listening point; in response to receiving an indication of a switch from the first listening point to a second listening point, means for controlling the rendering of the audio based at least on signaling associated with at least the first audio object, wherein the signaling comprises one or more conditions indicating whether playback of the first audio object is to continue during and/or after the switch to the second listening point.

In an example embodiment, a computer readable medium comprising program instructions is provided for causing an apparatus to perform at least the following: determining a first listening point of a user in an audio space, wherein the audio space comprises at least the first listening point and a second listening point; rendering audio associated with at least one first audio object of the first listening point based on a position and/or orientation of the user relative to the first listening point; in response to receiving an indication of a switch from the first listening point to a second listening point, controlling the rendering of the audio based at least on signaling associated with at least the first audio object, wherein the signaling comprises one or more conditions indicating whether playback of the first audio object is to continue during and/or after the switch to the second listening point.

In an example embodiment, an apparatus is provided comprising: at least one processor; and at least one non-transitory memory including computer program code, the at least one memory and the computer program code configured to, with the at least one processor, cause the apparatus to perform at least the following: determine a first listening point of a user in an audio space, wherein the audio space comprises at least the first listening point and a second listening point; render audio associated with at least one first audio object of the first listening point based on a position and/or orientation of the user relative to the first listening point; in response to receipt of an indication of a switch from the first listening point to a second listening point, control the rendering of the audio based at least on signaling associated with at least the first audio object, wherein the signaling comprises one or more conditions indicating whether playback of the first audio object is to continue during and/or after the switch to the second listening point.

BRIEF DESCRIPTION OF THE DRAWINGS

Some example embodiments will now be described with reference to the accompanying drawings.

DETAILED DESCRIPTION

Various exemplary embodiments herein describe techniques for controlling audio in multi-viewpoint omnidirectional content. Additional description of these techniques is presented after a system into which the exemplary embodiments may be used is described.

Figure 1:
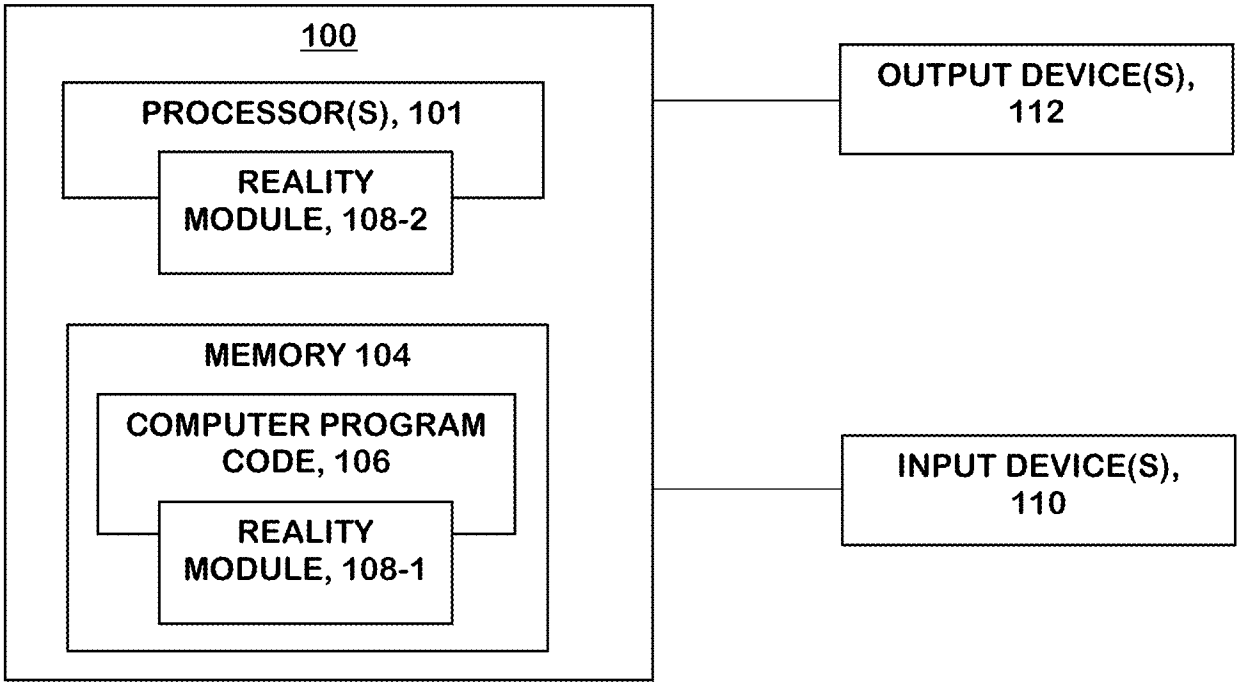
FIG. 1 is a block diagram of one possible and non-limiting exemplary apparatus in which various example embodiments may be practiced.

In FIG. 1, an apparatus 100 is shown that includes one or more processors 101, one or more memories 104 interconnected through one or more buses 112. The one or more buses 112 may be address, data, or control buses, and may include any interconnection mechanism, such as a series of lines on a motherboard or integrated circuit, fiber optics or other optical communication equipment, and the like. The one or more memories 104 include computer program code 106. The apparatus 100 may include a reality module, comprising one of or both parts 108-1 and/or 108-2, which may be implemented in a number of ways. The reality module may be implemented in hardware as reality module 108-2, such as being implemented as part of the one or more processors 101. The reality module 108-2 may be implemented also as an integrated circuit or through other hardware such as a programmable gate array. In another example, the reality module may be implemented as reality module 108-2, which is implemented as computer program code 106 and is executed by the one or more processors 101. For instance, the one or more memories 104 and the computer program code 106 may be configured to, with the one or more processors 101, cause the apparatus 100 to perform one or more of the operations as described herein.

The one or more computer readable memories 104 may be of any type suitable to the local technical environment and may be implemented using any suitable data storage technology, such as semiconductor based memory devices, flash memory, magnetic memory devices and systems, optical memory devices and systems, fixed memory and removable memory. The computer readable memories 104 may be means for performing storage functions. The processor(s) 101 may be of any type suitable to the local technical environment, and may include one or more of general purpose computers, special purpose computers, microprocessors, digital signal processors (DSPs) and processors based on a multi-core processor architecture, as non-limiting examples. The processor(s) 101 may be means for performing functions, such as controlling the apparatus 100 and other functions as described herein.

In some embodiments, the apparatus 100 may include one or more input(s) 110 and/or output(s) 112. The input(s) 110 may comprise any commonly known device for providing user input to a computer system such as a mouse, a keyboard, a touch pad, a camera, a touch screen, and/or a transducer. The input(s) 110 may also include any other suitable device for inputting information into the system 100, such as another device In some embodiments, the apparatus 100 may include one or more input(s) 110 and/or output(s) 112. The input(s) 110 may comprise any commonly known device for providing user input to a computer system such as a mouse, a keyboard, a touch pad, a camera, a touch screen, and/or a transducer. The input(s) 110 may also include any other suitable device for inputting information into the apparatus 100, such as a GPS receiver, a sensor, and/or other computing devices for example. The sensor may be a gyro-sensor, pressure sensor, geomagnetic sensor, light sensor, barometer, hall sensor, and/or the like. The output(s) 112 may comprise, for example, one or more commonly known displays (such as a projector display, a near-eye display, a VR headset display, and/or the like), speakers, and a communications output to communicate information to another device. The inputs 110/outputs 112, may include a receiver and/or a transmitter for wired and/or wireless communications (such as WiFi, BLUETOOTH, cellular, NFC, Ethernet and/or the like). In some embodiments, each of the input(s) 110 and/or output(s) 112 may be integrally, physically, or wirelessly connected to the apparatus 100.

In general, the various embodiments of the apparatus 100 can include, but are not limited to cellular telephones such as smart phones, tablets, personal digital assistants (PDAs), computers such as desktop and portable computers, gaming devices, VR headsets/goggles/glasses, music storage and playback appliances, tablets, as well as portable units or terminals that incorporate combinations of such functions.

In some example embodiments the apparatus 100 may correspond to system for creating immersive media content via content creations tools, a system for rendering immersive media content, and/or a system for delivering immersive media content to another device as is described in more detail below.

Having thus introduced one suitable but non-limiting technical context for the practice of the various exemplary embodiments, the exemplary embodiments will now be described with greater specificity.

Various example embodiments relate to rendering of immersive audio media (in either audio-only or audio-visual context) and signaling related to controlling this rendering.

In a 3D space, there are in total six degrees of freedom (DoF) that define the way a user may move within said space. This movement is generally divided into two categories: rotational and translational movement, each of which includes three degrees of freedom. Rotational movement is sufficient for a simple VR experience where the user may turn her head (pitch, yaw, and roll) to experience the space from a static point or along an automatically moving trajectory. Translational movement means that the user may also change the position of the rendering, namely, the user may move along the x, y and z axes according to their wishes. Free-viewpoint AR/VR experiences allow for both rotational and translational movements. It is common to talk about the various degrees of freedom and the related experiences using the terms 3DoF, 3DoF+ and 6DoF. 3DoF+ falls somewhat between 3DoF and 6DoF. It allows for some limited user movement, for example, it can be considered to implement a restricted 6DoF where the user is sitting down but can lean their head in various directions with content rendering being impacted accordingly.

The technical implementation of multi-viewpoint media content is typically such that a media file includes multiple streams related to multiple "isolated yet related" viewpoints (or listening points) in a mediated content environment.

Figure 2:
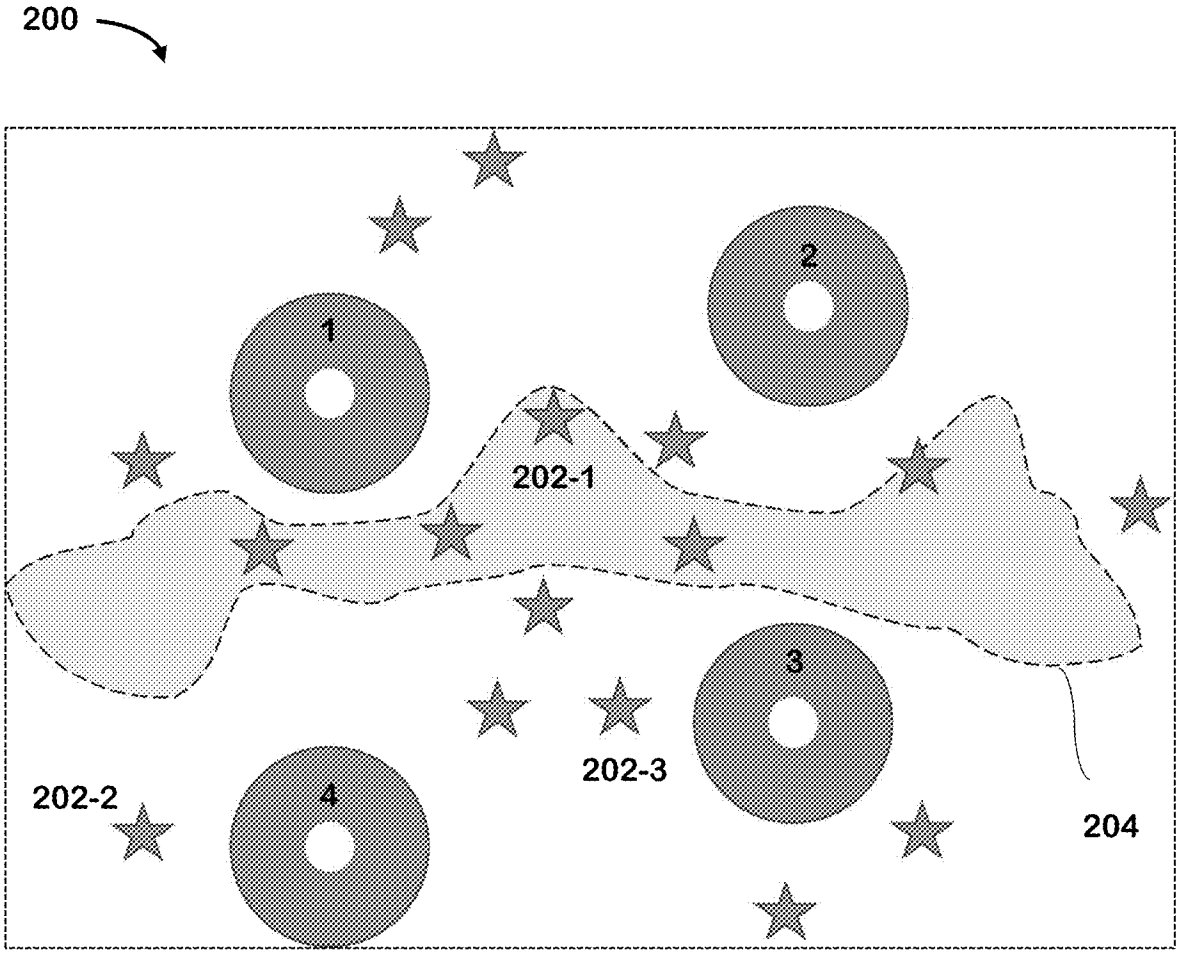
FIG. 2 represents a multi-viewpoint content space 200 of an audio-visual experience file in accordance with some example embodiments.

Referring now to FIG. 2, this figure represents a multi-viewpoint content space 200 of an audio-visual experience file in accordance with some example embodiments. In this example, the user has four possible listening/viewing points (which also may be referred to as listening/viewing areas) in the multi-viewpoint content file that are labeled 1-4. A user may first consume the content at a first viewpoint (also referred to herein as a listening point), and then may 'move' or 'teleport' to other viewpoints without interrupting the overall experience. In FIG. 2, the central part of each donut-shaped viewing area corresponds to, for example, the 3DoF(+) sweet spot, and the darker area corresponds to the "roamable" area (3DoF+ or restricted 6DoF). The user may be free to choose the order and timing of any switch between these viewpoints or scenes (in case of restricted 6DoF). The dashed area 204 in the middle of FIG. 2 represents an 'obstacle' in the content. For example, the obstacle may be a wall, a mountain, and/or the like. Such obstacles can limit at least the line of sight, but potentially also the audibility of at least some audio content. In FIG. 2, different audio sources are represented as a star symbols. At least the audio sources shown on top of the dashed area, such as audio source 202-1 for example, may be audible to all directions/viewpoints within the scene file, whereas other audio sources may be audible to a limited amount of viewpoints. For example, audio source 202-2 may be audible to only viewpoint 4, whereas audio source 202-3 may be audible to only viewpoints 3 and 4, for example.

In addition to "natural" boundaries (such as walls and mountains, for example), there may be other types of boundaries in the content, for example, a multi-viewpoint content file may include or consist of "virtual rooms" that limit, for example, at least the audibility of some audio content across their "virtual walls". It is also noted that viewpoints in a virtual content file may be very distant from each other and may even represent different points in time or, e.g., different "paths" of an interactive story. In further examples, viewpoints in a virtual content file may correspond to customer tier levels, where, e.g., a "platinum level" customer is offered richer or otherwise different content or parts of content than a "gold level" or "silver level" customer. On the other hand, switching between viewpoints in a virtual content file can happen at very different frequencies. For example, a user may wish to quickly view a specific scene from various available points of view around the scene and continuously switch back and forth between them, whereas in most services it may be unlikely, e.g., for a user to be upgraded in tier more than once during even a long content consumption.

Considering the above, it is generally beneficial to have different audio content (for example audio objects and/or channel bed) for each viewpoint in a media content file that is not continuously "roamable" by the user. For example, unrestricted 6DoF content may be considered continuously "roamable". It is noted that switching from a first viewpoint to a second viewpoint will in such case disrupt the audio rendering and presentation. Without some smoothing (such as a crossfade for example), such disruption can be extremely annoying to the user (as it may be heard as clicks and pops). Therefore, in any such application, at least some smoothing of the audio under switching is expected.

In addition to diegetic audio content (that takes the user's position/rotation into account in rendering), non-diegetic audio may also be used such that the audio remains fixed regardless of at least the user's head rotation. Non-diegetic audio content may have directional properties for example, but the directions are fixed relative to the user. Such content rendering is useful in certain situations. For example, a content creator may desire a first piece of background music to continue even when a user switches to a new viewpoint, even if the new viewpoint is associated with a different piece of background music. For instance, it may be helpful for the first piece of background music to continue (with same or different sound level) until for some amount of time, until occurrence of a certain event in the music or the overall content, and/or the like. This may also be true for other types of non-diegetic audio such as a narrator's commentary or other types of diegetic dialogue for example.

In some circumstances, different viewpoints may feature different pieces of background music. Typically these cases are not handled in the way the content creator intended and can become very distracting for the user when switching between viewpoints even if some type of smoothing is applied. For example, when a user switches between a first viewpoint to a second viewpoint this can cause a switch from a first piece of background music to a second piece of background music even when the first background music should ideally be maintained during these switches under some (potentially content-creator specified) circumstances.

The various example embodiments described herein provide more control of how audio is rendered and presented to the user. For example, signaling (e.g. metadata) may be provided corresponding to audio that specifies under what conditions, and in what way, the playback of at least part of that audio is continued in a second listening/viewpoint (during and after the switching of listening/viewpoint) where the audio is otherwise not present at the second listening/viewpoint. For example, the audio may not otherwise be present at the second listening point based on the user's position and/or orientation, or the audio might not be present as it is not included in a second media content file being opened due to the switching (such as some 'scene description', or 'viewpoint description' for 3DoF, for example).

The audio may also be a different audio waveform but correspond to the same 'physical audio source' such as when dialogue includes two different actors. For example, a listener may travel a story in time, where a person in a scene is also the narrator of the story. In this case, a listener may begin this story by entering the playback when the person is an adult, and the listener may travel back in time (e.g. to a second listening/viewpoint) when the person is a child. The content creator will for such a case have a choice whether the person in the scene continues the dialogue as an adult or child.

In addition, some embodiments allow the audio of a previous listening viewpoint to "be connected" or linked to other audio of a second listening/viewpoint, and the playback of the other audio can be prevented at least for the duration of the continued playback of the first audio. In some examples, the audio and the other audio may be the same audio (such as the same audio source) but have different rendering properties at the different listening/viewpoints. At least some of the rendering properties of the audio at the first listening/viewpoint may replace the corresponding properties of the audio at the other listening point/viewpoint according to, e.g., the signaling.

Some of the features described herein may be particularly helpful in situations when the switch relates to a jump or separation (such as in time, space, or some other contextual aspect for example) that is different from the usual displacement of the listening point when the user translates.

For ease of understanding, the description herein generally refers to background music, however, various example embodiments described herein apply equally to any other audio types that are intended to continue across a viewpoint or scene change in 3DoF/3DoF+/6DoF regardless of the new viewpoint or scene not having the same audio due to, at least, the timing or order of user's viewpoint changes or any other previous user action (such as for story-telling purposes or any other artistic or content creator intent).

The term 'audio space' is generally used herein to refer to a three-dimensional space defined by a media content file having at least two different listening points such that a user may switch and/or move between the different listening points. The switching may relate to space, time, or some other contextual aspect (such as a story element or a rule set defined by a content creator for example). Thus, it should be understood that a user may be able to move and/or switch between the at least two listening points in the audio space via user input, a service or content dependent aspect may trigger switching between the at last two different listening points, and/or the switching may relate to any other contextual aspect (such as a story element, a rule set by a content creator, and/or the like)

Non-limiting examples of an 'audio object' are an audio source with a spatial position, a channel-based bed, scene-based audio represented as a First-Order Ambisonic/Higher-Order Ambisonic (FOA/HOA), a metadata-assisted spatial audio (MASA) representation of a captured audio scene, or any audio that has metadata associated with it in the context of the media content being experienced by the user.

As described in more detail below, some aspects described herein can be implemented in various parts of the content creation-content delivery-content consumption process. For example, some aspects are aimed at improving content creation tools for audio software for AR/MR/VR content creation that are delivered alongside the audio waveform content as metadata (such as tools for defining the flags and switching pattern rules for example); some aspects relate to the media file format and metadata description (such as MPEG-I standard for example); and some aspects relate to an audio content rendering engine in an AR/MR/VR device or application such as an AR headphone device, a mobile client, or an MPEG-I compliant audio renderer. As such, various example embodiments improve the content creator's control over the immersive AR/MR/VR experiences by allowing the audio rendering to be more consistent (for example, with respect to the story line of the content for example) while enabling more freedom for the end user (such as increased personalization of the content consumption experience for example).

Metadata Implementation

Some example embodiments relate to the selection and rendering of transmitted audio streams (objects, items). In such examples, an audio stream may include both the audio waveform of one or more audio objects as well as metadata (or signaling). For example, the metadata may be transmitted alongside the (encoded) audio waveforms. The metadata may be used to render the audio objects in a manner consistent with the content creator's intent or service or application or content experience design.

For instance, metadata may be associated with a first audio object (such as a first audio object at a first listening point for example) such that the metadata describes how to handle that first audio object when switching to a second listening point. Metadata can be associated with a first audio object and at least a second audio object (such as an audio object from the second listening point), in which case the metadata describes how to handle the first audio object and how this relates or effects how the at least one second audio object is handled. In this situation, the current/first audio object is part of the scene the user is switching from, and the at least one other audio object may be part of the scene the user switching to. It is also possible that the metadata could be associated with only the second audio object, in which case the system would 'look back' for the audio object rather than 'looking forward' as is the case in the implementations above.

In one example embodiment, metadata is provided for different 'perception zones' and is used to signal a change in the audio depending on change in the user's viewpoint when consuming, for example, 3DoF/3DoF+/6DoF media content. For example, multi-viewpoint in case of 6DoF may include switching across overlapping or non-overlapping perception zones (e.g., from room 1 to room 2), where each perception zone may be described as a ViewpointCollection which comprises of multiple ViewpointAudioItems. Depending on the viewpoint change situation, the content creator may specify if the ViewpointAudioItems should switch immediately or persist longer. This information may be determined by the switching device renderer or signaled by the content creator. Thus, in some examples different sets of audio objects may be associated with different audio or perception 'zones', where switching between different listening points/viewpoints switches between the different audio zones. For example, a first set of audio objects may be associated with a first audio zone and a second set of audio objects may be associated with a second audio zone such that a switch between first and second listening points/viewpoints causes a switch between the first audio zone and the second audio zone.

In some cases, the first set of audio objects and the second set of audio objects may partially overlap (such as an audio object associated with the same audio waveform for example). The audio objects that overlap may each have a rendering property (such as an audio level for example) where the value of the rendering property may be similar or different. The value may be similar in the sense that the difference in the value of the rendering property would be generally imperceivable to the user when switching between the listening/viewing points. In such cases, an option can be provided to ignore signaling related to handling an audio object when switching between listening points. The indication may be set by the content creator, e.g., to reduce complexity or memory consumption. If such content being transmitted, then it is also possible that such signaling is not sent to the renderer. In cases where the difference in the value of the rendering property would be perceivable, then signaling (e.g. metadata) can be provided that describes how to handle at least the rendering property of the overlapped audio objects during and/or after the switch between the different listening points.

It should be understood that signaling (e.g. metadata) described herein may be associated with one or more individual properties of one or more audio objects, one or more audio objects, one or more listening points/viewpoints, and/or one or more audio zones, and thus allows significant flexibility and control of audio when switching between different listening points/viewpoints.

In some example embodiments, when playback of an audio object from a previous listening point/viewpoint is continued during and/or after a switch to a current listening point/viewpoint, then a renderer may treat that audio object as being part of the current viewpoint at least for an amount of time that the playback of the audio object is continued at the current viewpoint. For example, the audio object could be added to a list of audio objects of the second listening point while playback of the audio object is continued. In another example, signaling associated with the audio object from the previous viewpoint/listening point may indicate that playback of the audio object is to continue during and/or after one or more further switches if the audio object is still being played back at the current listening point. If another switch is made from the current listening point to a next viewpoint/listening point (which may include a switch back to the previous viewpoint/listening point) the audio object may be handled accordingly. In this way, embodiments allow an audio object from a first listening to be adaptively handled through multiple switches between multiple listening points/viewpoints.

Table 1 below describes metadata for a ViewpointCollection in accordance with an example embodiment. In this example, an audio-object type representation of the audio scene is used, however, it is understood that other representations are also possible for audio objects.

TABLE 1

| Metadata key | Type | Description |
|---|---|---|
| ViewpointCollection | List | Collection of media objects representing a multi-viewpoint scene and related information. |
| ViewpointAudioItem | Object | Audio object or element. Information on waveform, various metadata, etc. defining the object or element. |
| PersistPlayback | List | A list of conditions when and how playback of audio object or element is continued during and after a switching to a different viewpoint. |
| PersistPlaybackConnectedItems | List | Collection of zero or more audio objects or elements that are connected to the current audio object or element. |
| DelayedSwitchPersist | List | A list of parameters for performing a delayed switching to the connected audio object or element during a switching with persistent playback. |
| switchDelayPersist | Boolean | Setting for whether the persisted playback of an audio object or element of a previous viewpoint is switched to playback of the connected item after a given time (defined, e.g., by switchDelayPersistTime media time parameter). |
| switchDelayPersistTime | Media Time | The media presentation start time relative to switching time. This time defines when the playback (e.g., a crossfade) begins following a viewpoint switching. Alternatively, the playback begins at the latest when the persistent playback of an audio object or element ends, e.g., due to running out of audio waveform (similarly allowing, e.g., for a crossfade), whichever comes first. |
| switchAfterPersist | Boolean | Setting for whether the persisted playback of an audio object or element of a previous viewpoint overrides the playback of the |

TABLE 1-continued

| Metadata key | Type | Description |
|---|---|---|
| | | connected item until its persistent playback end. The playback of the connected audio object or element is permitted after this. |
| switchOffPersist | Boolean | Setting for whether the persisted playback of an audio object or element of a previous viewpoint overrides the playback of the connected item. |

It is noted that the metadata keys, types, and description below are merely examples and are not intended to be limiting. For example, some of the metadata described in Table 1 may be optional as it corresponds to advanced features, different names of the metadata keys may be used, and/or the like.

Renderer Implementation

An audio content rendering engine typically corresponds to software that puts together the audio waveforms that are presented to the user. The presentation may be through headphones or using a loudspeaker setup. The audio content rendering engine may run, for example, on a general-purpose processor or dedicated hardware.

Figure 3:
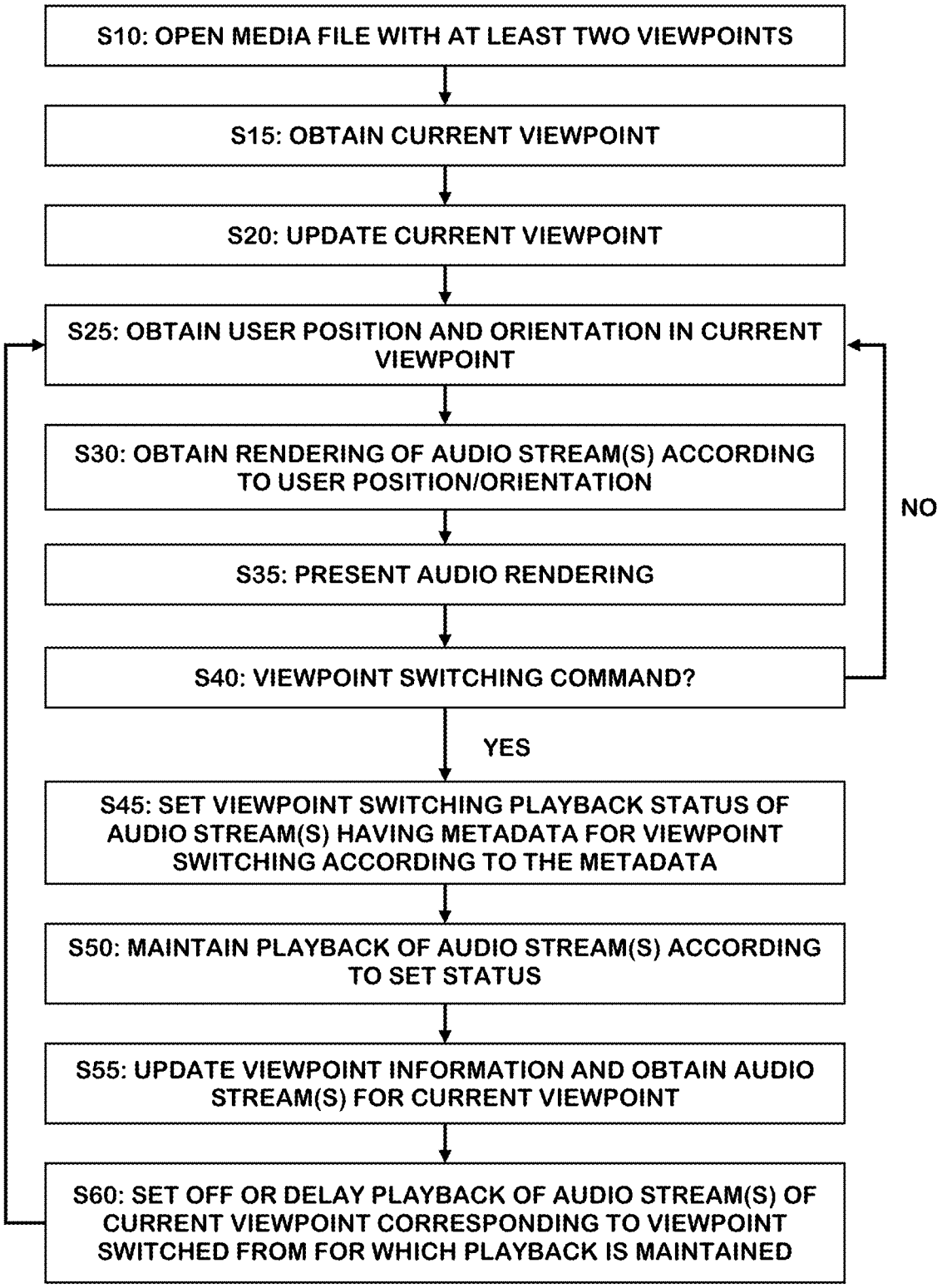
FIG. 3 is a high-level process flow diagram in accordance with some example embodiments.

Referring now to FIG. 3, this figure shows a high-level process flow diagram in accordance with an example embodiment. The process may be implemented in an audio content rendering engine for example. At step S10, a user opens a media file where the media file includes at least two viewpoints. Steps S15-60 may be performed while the media file is open. At step S15, the current view point is obtained. In some examples the viewpoint may be obtained based on a user input such as the user providing an input to select a starting viewpoint. Alternatively, the starting viewpoint may be predetermined such as being read from the media file or being given by an AR user tracking system. At step S20, the viewpoint information is updated and audio streams are obtained for the current viewpoint. At step S25, the user position and orientation is obtained in the current viewpoint. At step S30, the rendering of audio streams is obtained according to the determined user position and orientation in the current viewpoint, and then the user is presented with the audio rendering at step S35. At step S40, if a viewpoint switching command is received then the process flow continues to step S45, otherwise process flows returns to step S25. The viewpoint switching command may come from, for example, a user input and/or the media content and/or an application/service. At step S45, a viewpoint switching playback status is set for at least one audio stream having metadata for viewpoint switching according to said metadata. At step S50, playback of the audio streams is maintained with the viewpoint switching playback information according to their set status. At step S55, the viewpoint information is updated and the audio streams for the current viewpoint are obtained. At step S60, the playback is set off or delayed for at least one audio stream of current viewpoint corresponding to the at least one audio viewpoint switched from for which playback is maintained. The process flow then returns to step S25.

It is noted that steps S25-30 in FIG. 2 may include, for example, user interaction modification to the rendering. In other words, the rendering of the audio streams may be modified in a way that does not strictly follow the position and/or orientation of the user, but also uses additional information from metadata of an audio object (such as instructions based on the PersistPlayback list or DelayedSwitchPersist list from Table 1, for example). As a non-limiting example of an interaction between a user and an audio object, a specific audio object may be rendered according to the user location/orientation in a 6DoF scene until the user reaches a limit of 1 meter of distance from the audio object, at which point said audio object becomes more and more non-diegetic and furthermore "sticks to" the user until the user "escapes" to at least 5-meter distance of the default audio object location. User interaction may also relate to very direct interaction in an interactive system, such as a user grapping, lifting, or otherwise touching an object that is also or relates to an audio object for example.

Figure 4:
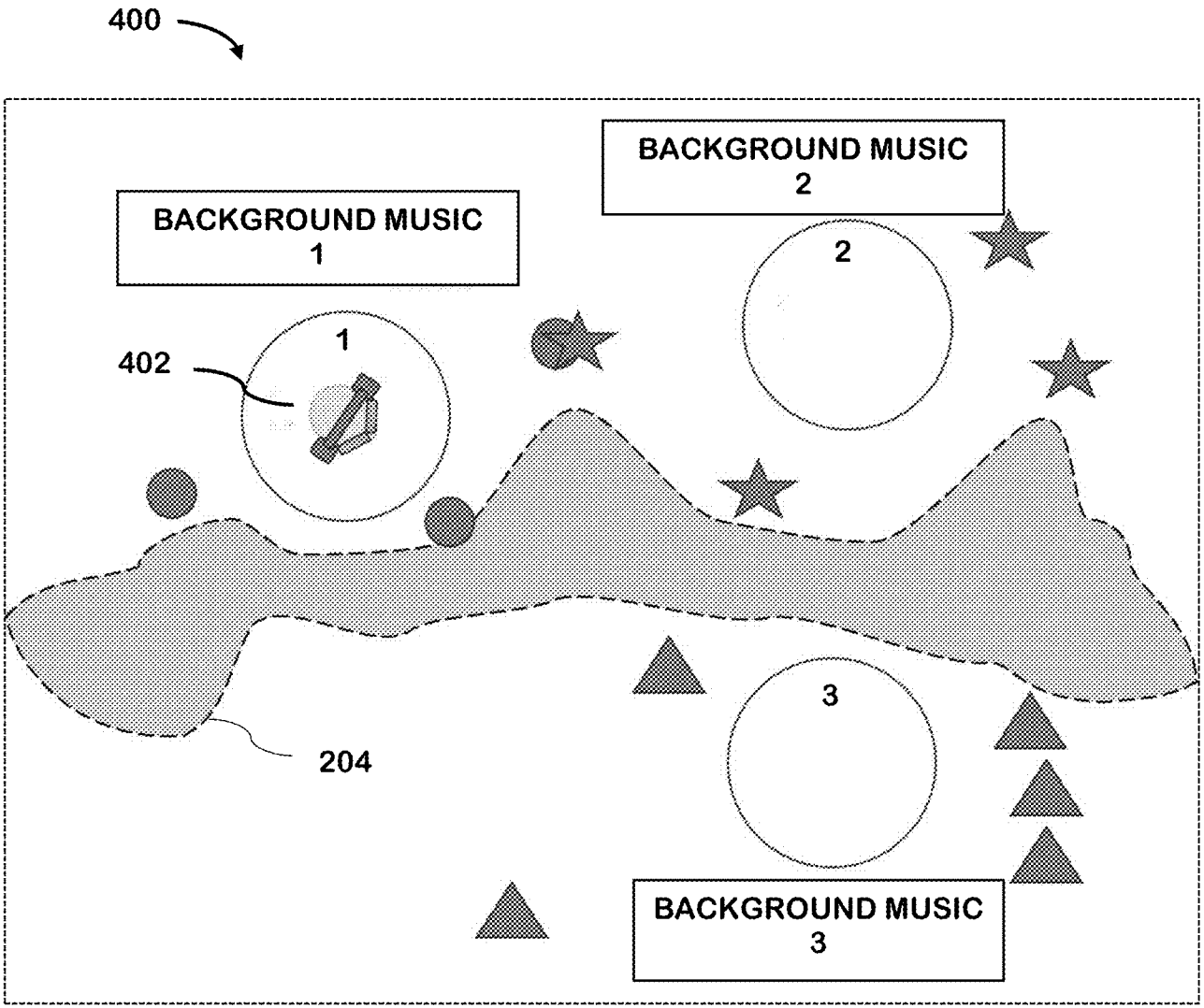
FIG. 4 represents a multi-viewpoint content space of an audio-visual experience file in accordance with some example embodiments.

Referring now to FIG. 4, this figure shows a top view representing a multi-viewpoint content space of an audio-visual 3DoF+ experience file in accordance with some example embodiments. A user 402 may launch an application to experience VR and open the multi-viewpoint file. In response to the opening of the file, the user may be presented with a first viewpoint 1, which may be considered the default starting viewpoint for this content. In FIG. 4, the default starting viewpoint is viewpoint 1 and the audio sources for each of the three viewpoints are represented using different symbols, namely, the circles represent audio sources associated with viewpoint 1, the stars represent audio sources associated with viewpoint 2, and the triangles represent audio sources associated with viewpoint 3. In addition to the audio sources, each viewpoint features a separate background music (namely, background music 1-3). Background music 1-3 may relate to, for example, aspects and artistic intent of the respective viewpoints. It is noted that the background music is merely an example, and example embodiments are also applicable to any other type of non-diegetic or diegetic audio.

The viewpoints 1, 2, and 3 in FIG. 4 of the multi-viewpoint 3DoF+ media file may be at the same time such as being a part of the same storyline where individual points of view progress the story/content with a different focus. In this way, a content creator may wish to treat the viewpoints as completely separate, as connected/'mirrored', or in some dynamic manner such as where the relation between, for example, viewpoints 1 and 2 may depend on a time instance of the overall presentation or a part of it or at least one user action. A user action may, for example, relate to what the user has done in the content, the amount of time spent in a certain viewpoint, the order of viewpoint switching, and/or the like.

Figure 5B:
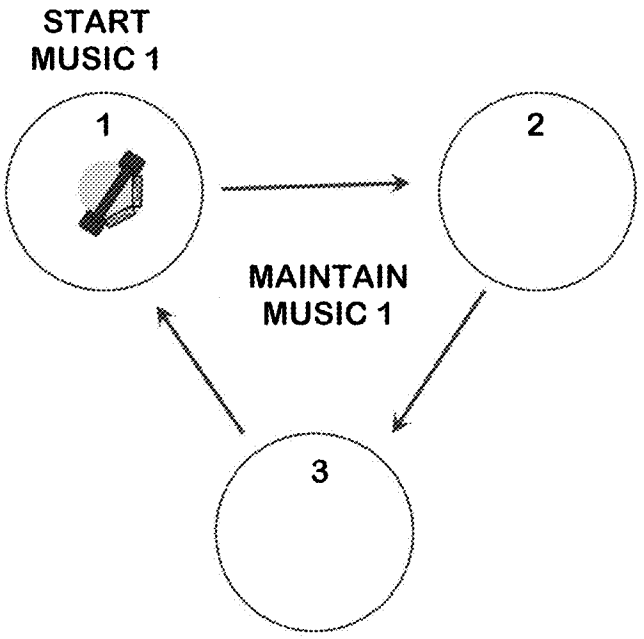
FIGS. 5A and 5B show different switching implementations of a multi-viewpoint file in accordance with some example embodiments.
Figure 5A:
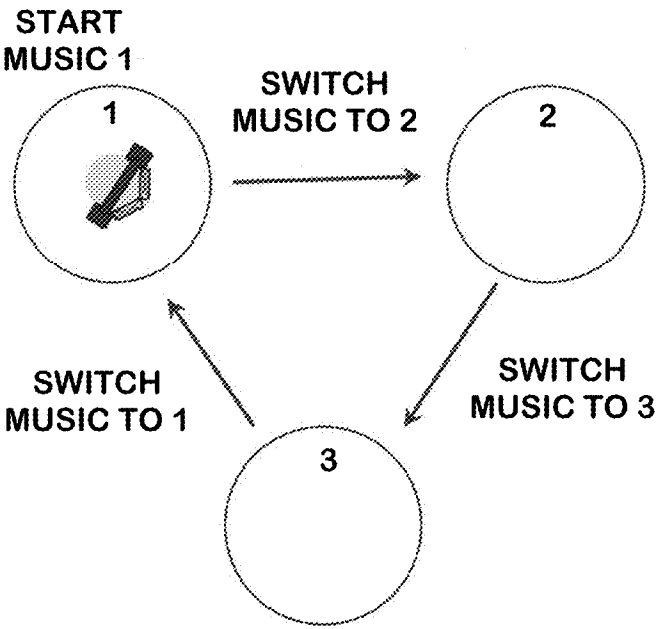

FIGS. 5A and 5B show different switching implementations of a multi-viewpoint file in accordance with some example embodiments. The different viewpoints in FIGS. 5A and 5B may correspond to those represented in FIG. 4 for example. In FIG. 5A, the viewpoints are switched according to the order of "1-2-3-1", which triggers the background music to change in this same order (namely, background music 1, background music 2, background music 3, background music 1). In FIG. 5B, the content creator can influence the switching decision of at least one audio object such as the background music. The content creator may do so, for example, by utilizing the audio content of a first viewpoint while presenting the audio (and visual) content of a second viewpoint that relates to different media content but may be part of the same media file. Thus, in FIG. 5B, when the viewpoints are changed in the order of 1-2-3-1, the background music 1 is maintained. In this way, the content creator has increased control of how certain audio objects are rendered when viewpoints are switched depending on the content creator settings and the associated metadata values.

As noted above, various example embodiments provide the content creator increased flexibility that was not previously available as illustrated in the following example. When the various example embodiments are not implemented, a user at a time instance T3 in viewpoint 3 hears the same audio in the following two cases:

1. the user begins viewing at T1 in viewpoint 1 and switches to viewpoint 2 for time T2 followed by a switch to viewpoint 3 at time T3', and
2. the user begins viewing at T1 in viewpoint 1 and switches to viewpoint 3 for time T2 followed by staying at 3 through time T3'.

On the other hand, various example embodiments may be implemented to allow the user at time T3 in viewpoint 3 to hear a different audio in the preceding two cases, which may be controlled by the content creator/producer via metadata. The various exemplary embodiments enable different, personalized content experiences, for example, based on the viewpoint switching patterns.

Figure 6:
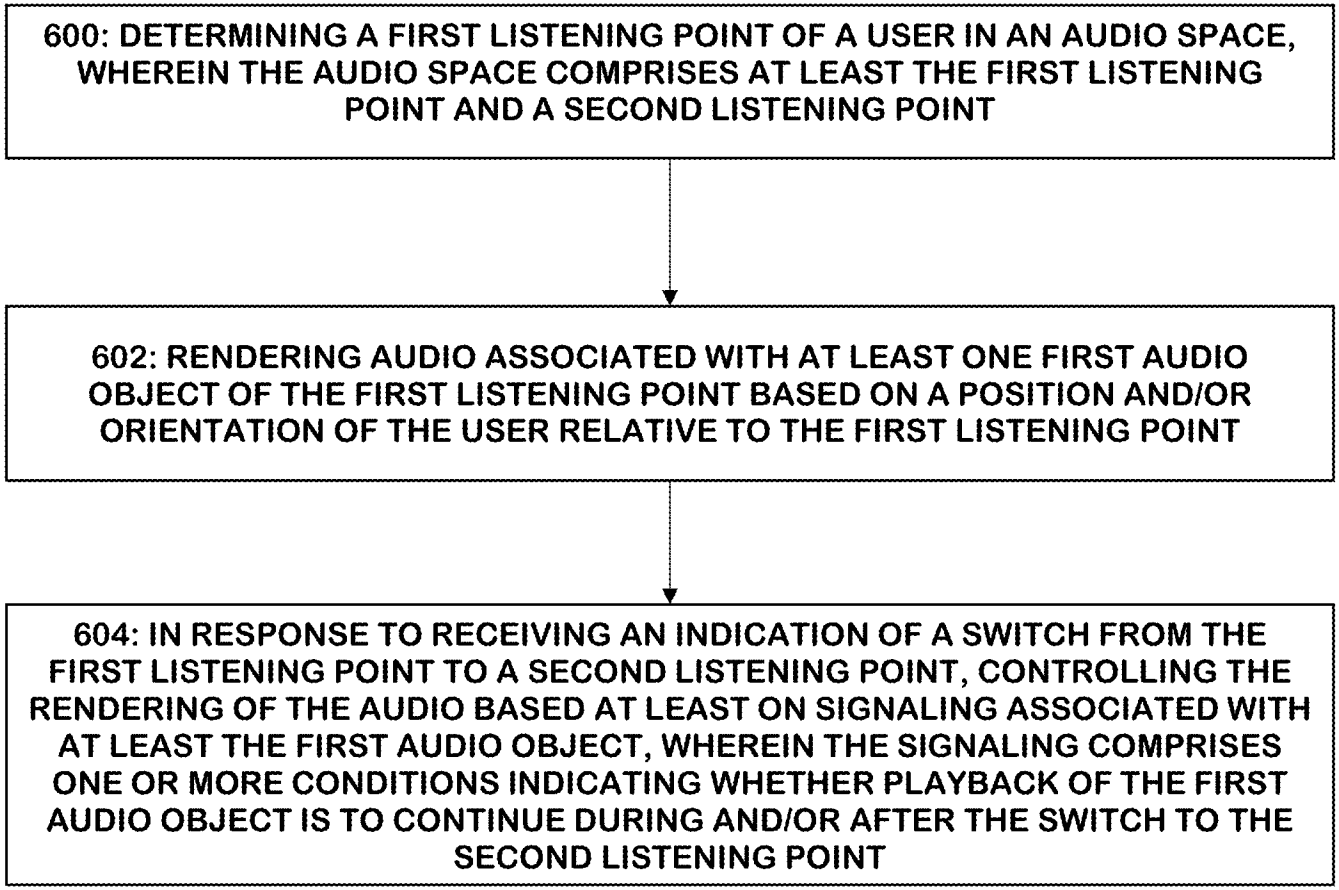
FIG. 6 is a logic flow diagram in accordance with various example embodiments, and illustrates the operation of an exemplary method, a result of execution of computer program instructions embodied on a computer readable memory, functions performed by logic implemented in hardware, and/or interconnected means for performing functions in accordance with exemplary embodiments.

FIG. 6 is a logic flow diagram for controlling audio in multi-viewpoint omnidirectional content. This figure further illustrates the operation of an exemplary method or methods, a result of execution of computer program instructions embodied on a computer readable memory, functions performed by logic implemented in hardware, and/or interconnected means for performing functions in accordance with exemplary embodiments. For instance, the reality module 108-1 and/or 108-2 may include multiples ones of the blocks in FIG. 6, where each included block is an interconnected means for performing the function in the block. The blocks in FIG. 6 are assumed to be performed by the apparatus 100, e.g., under control of the reality module 108-1 and/or 108-2 at least in part.

According to an example embodiment a method is provided comprising: determining a first listening point of a user in an audio space, wherein the audio space comprises at least the first listening point and a second listening point as indicated by block 600; rendering audio associated with at least one first audio object of the first listening point based on a position and/or orientation of the user relative to the first listening point as indicated by block 602; and in response to receiving an indication of a switch from the first listening point to a second listening point, controlling the rendering of the audio based at least on signaling associated with at least the first audio object, wherein the signaling comprises one or more conditions indicating whether playback of the first audio object is to continue during and/or after the switch to the second listening point as indicated by block 604. The signaling associated with the first audio object may include a value corresponding to an amount of time playback of the first audio object is to continue during and/or after the switch to the second listening point. Controlling the rendering of the audio may include rendering at least one second audio object of the second listening point during and/or after the switch. The signaling may link the first audio object to at least one second audio object such that playback of the at least one second audio object be delayed based on the one or more conditions in the signaling. The playback of the second audio object may be delayed until after the rendering of the first audio object is completed. Controlling the rendering of the audio may include performing a crossfade between the first audio object and the second audio object based on the signaling. The crossfade may be performed after an amount time indicated in the signaling following the switch. Controlling the rendering of the audio may include causing playback of at least one audio object of the second viewpoint to be prevented while the user remains at the second listening point based on the signaling. Rendering of the audio in response to receiving the indication of the switch from the first listening point to the second listening point may be further based on a current position and/or orientation of the user relative to the second viewpoint. The method may further comprise playing back the rendering of the audio.

In an example embodiment, an apparatus is provided comprising: means for determining a first listening point of a user in an audio space, wherein the audio space comprises at least the first listening point and a second listening point; means for rendering audio associated with at least one first audio object of the first listening point based on a position and/or orientation of the user relative to the first listening point; in response to receiving an indication of a switch from the first listening point to a second listening point, means for controlling the rendering of the audio based at least on signaling associated with at least the first audio object, wherein the signaling comprises one or more conditions indicating whether playback of the first audio object is to continue during and/or after the switch to the second listening point. The signaling associated with the first audio object may include a value corresponding to an amount of time playback of the first audio object is to continue during and/or after the switch to the second listening point. Controlling the rendering of the audio may include rendering at least one second audio object of the second listening point during and/or after the switch. The signaling may link the first audio object to at least one second audio object such that playback of the at least one second audio object be delayed based on the one or more conditions in the signaling. The playback of the second audio object may be delayed until after the rendering of the first audio object is completed. Controlling the rendering of the audio may include performing a crossfade between the first audio object and the second audio object based on the signaling. The crossfade may be performed after an amount time indicated in the signaling following the switch. Controlling the rendering of the audio may include causing playback of at least one audio object of the second viewpoint to be prevented while the user remains at the second listening point based on the signaling. Rendering of the audio in response to receiving the indication of the switch from the first listening point to the second listening point may be further based on a current position and/or orientation of the user relative to the second viewpoint. The apparatus may further include means for playing back the rendering of the audio.

In an example embodiment, a computer readable medium is provided comprising program instructions for causing an apparatus to perform at least the following: determining a first listening point of a user in an audio space, wherein the audio space comprises at least the first listening point and a second listening point; rendering audio associated with at least one first audio object of the first listening point based on a position and/or orientation of the user relative to the first listening point; in response to receiving an indication of a switch from the first listening point to a second listening point, controlling the rendering of the audio based at least on signaling associated with at least the first audio object, wherein the signaling comprises one or more conditions indicating whether playback of the first audio object is to continue during and/or after the switch to the second listening point. The signaling associated with the first audio object may include a value corresponding to an amount of time playback of the first audio object is to continue during and/or after the switch to the second listening point. Controlling the rendering of the audio may include rendering at least one second audio object of the second listening point during and/or after the switch. The signaling may link the first audio object to at least one second audio object such that playback of the at least one second audio object be delayed based on the one or more conditions in the signaling. The playback of the second audio object may be delayed until after the rendering of the first audio object is completed. Controlling the rendering of the audio may include performing a crossfade between the first audio object and the second audio object based on the signaling. The crossfade may be performed after an amount time indicated in the signaling following the switch. Controlling the rendering of the audio may include causing playback of at least one audio object of the second viewpoint to be prevented while the user remains at the second listening point based on the signaling. Rendering of the audio in response to receiving the indication of the switch from the first listening point to the second listening point may be further based on a current position and/or orientation of the user relative to the second viewpoint. The computer readable medium may further include program instructions for causing the apparatus to play back the rendering of the audio.

In an example embodiment, an apparatus is provided comprising: at least one processor; and at least one non-transitory memory including computer program code, the at least one memory and the computer program code configured to, with the at least one processor, cause the apparatus to perform at least the following: determine a first listening point of a user in an audio space, wherein the audio space comprises at least the first listening point and a second listening point; render audio associated with at least one first audio object of the first listening point based on a position and/or orientation of the user relative to the first listening point; in response to receipt of an indication of a switch from the first listening point to a second listening point, control the rendering of the audio based at least on signaling associated with at least the first audio object, wherein the signaling comprises one or more conditions indicating whether playback of the first audio object is to continue during and/or after the switch to the second listening point. The signaling associated with the first audio object may include a value corresponding to an amount of time playback of the first audio object is to continue during and/or after the switch to the second listening point. Control of the rendering of the audio may include rendering at least one second audio object of the second listening point during and/or after the switch. The signaling may link the first audio object to at least one second audio object such that playback of the at least one second audio object be delayed based on the one or more conditions in the signaling. The playback of the second audio object may be delayed until after the rendering of the first audio object is completed. Control of the rendering of the audio may include performing a crossfade between the first audio object and the second audio object based on the signaling. The crossfade may be performed after an amount time indicated in the signaling following the switch. Control of the rendering of the audio may include causing playback of at least one audio object of the second viewpoint to be prevented while the user remains at the second listening point based on the signaling. Render of the audio in response to receiving the indication of the switch from the first listening point to the second listening point may be further based on a current position and/or orientation of the user relative to the second viewpoint. The at least one memory and the computer program code may be configured to, with the at least one processor, cause the apparatus to play back the rendering of the audio.

Without in any way limiting the scope, interpretation, or application of the claims appearing below, a technical effect of one or more of the example embodiments disclosed herein is providing improved audio scene control of the multi-viewpoint media content/file rendering/presentation. Another technical effect of one or more of the example embodiments disclosed herein is providing the end user a more coherent and immersive user experience responding to personal usage scenarios by enabling smooth/natural transitions within and between, for example, thematic passages that take into account both the content and the viewpoint selection by the user. Another technical effect of one or more of the example embodiments disclosed herein is avoiding annoying discontinuities and unintentional switching back and forth between audio items. Another technical effect of one or more of the example embodiments disclosed herein is enabling one media file to provide different, personalized content experiences based on the viewpoint switching patterns.

Embodiments herein may be implemented in software (executed by one or more processors), hardware (e.g., an application specific integrated circuit), or a combination of software and hardware. In an example embodiment, the software (e.g., application logic, an instruction set) is maintained on any one of various conventional computer-readable media. In the context of this document, a "computer-readable medium" may be any media or means that can contain, store, communicate, propagate or transport the instructions for use by or in connection with an instruction execution system, apparatus, or device, such as a computer, with one example of a computer described and depicted, e.g., in FIG. 1. A computer-readable medium may comprise a computer-readable storage medium (e.g., memory 104 or other device) that may be any media or means that can contain, store, and/or transport the instructions for use by or in connection with an instruction execution system, apparatus, or device, such as a computer. A computer-readable storage medium does not comprise propagating signals.

If desired, the different functions discussed herein may be performed in a different order and/or concurrently with each other. Furthermore, if desired, one or more of the above-described functions may be optional or may be combined.

Although various aspects of the invention are set out in the independent claims, other aspects of the invention comprise other combinations of features from the described embodiments and/or the dependent claims with the features of the independent claims, and not solely the combinations explicitly set out in the claims.

It is also noted herein that while the above describes example embodiments of the invention, these descriptions should not be viewed in a limiting sense. Rather, there are several variations and modifications which may be made without departing from the scope of the present invention as defined in the appended claims.

The following abbreviations that may be found in the specification and/or the drawing figures are defined as follows:

3DoF 3 degrees of freedom (head rotation)
3DoF+3DoF with additional limited translational movements (e.g. head movements)
6DoF 6 degrees of freedom (head rotation and translational movements)
3GPP 3rd Generation Partnership Project
AR Augmented Reality
EVS Enhanced Voice Services
IVAS EVS Codec extension for Immersive Voice and Audio Services
MPEG Moving Picture Experts Group
MR Mixed Reality
VR Virtual Reality

What is claimed is:

1. An apparatus comprising:

at least one processor; and at least one non-transitory memory including computer program code, the at least one non-transitory memory and the computer program code configured to, with the at least one processor, cause the apparatus to at least:

determine a first listening point in an audio space with which a position and/or orientation of a user is associated, wherein the audio space comprises at least the first listening point and a second listening point;

render audio associated with at least one first audio object of the first listening point based on the position and/or orientation of the user relative to the first listening point;

in response to receiving an indication of a switch from the first listening point to the second listening point, control the rendering of the audio based on at least one signaling associated with at least the at least one first audio object of the first listening point, wherein the at least one signaling comprises one or more conditions for continuing playback of at least the at least one first audio object of the first listening point in response to the indication of the switch to the second listening point, wherein the at least one first audio object is part of a spatial audio content rendered to the user at the second listening point, wherein, in response to controlling the rendering of the audio based on the at least one signaling associated with at least the at least one first audio object, the spatial audio content rendered to the user at the second listening point is different from a spatial audio content based on a position and/or orientation of the user relative to the second listening point after the switch.

2. The apparatus as in claim 1, wherein the at least one signaling associated with the at least one first audio object of the first listening point comprises a value corresponding to an amount of time playback of at least the at least one first audio object of the first listening point is to continue during and/or after the switch to the second listening point.

3. The apparatus as in claim 1, wherein controlling the rendering of the audio comprises rendering at least one second audio object of the second listening point during and/or after the switch.

4. The apparatus as in claim 1, wherein the at least one signaling links the at least one first audio object of the first listening point to at least one second audio object such that playback of the at least one second audio object is delayed based on the one or more conditions in the at least one signaling.

5. The apparatus as in claim 4, wherein the playback of the at least one second audio object is delayed until after the rendering of the at least one first audio object of the first listening point is completed.

6. The apparatus as in claim 1, wherein controlling the rendering of the audio comprises performing a crossfade between the at least one first audio object of the first listening point and a second audio object based on the at least one signaling.

7. The apparatus as in claim 6, wherein the crossfade is performed after an amount of time indicated in the at least one signaling following the switch.

8. The apparatus as in claim 1, wherein controlling the rendering of the audio comprises causing playback of at least one audio object of the second listening point to be prevented while the user remains at the second listening point based on the at least one signaling.

9. The apparatus as in claim 1, wherein controlling the rendering of the audio in response to receiving the indication of the switch from the first listening point to the second listening point is further based on a current position and/or orientation of the user relative to the second listening point.

10. The apparatus as in claim 1, wherein the at least one non-transitory memory and the computer program code may be configured to, with the at least one processor, cause the apparatus to play back the rendering of the audio.

11. A method comprising:

determining a first listening point in an audio space with which a position and/or orientation of a user is associated, wherein the audio space comprises at least the first listening point and a second listening point;

rendering audio associated with at least one first audio object of the first listening point based on the position and/or orientation of the user relative to the first listening point;

in response to receiving an indication of a switch from the first listening point to the second listening point, controlling the rendering of the audio based on at least one signaling associated with at least the at least one first audio object of the first listening point, wherein the at least one signaling comprises one or more conditions for continuing playback of the at least one first audio object of the first listening point in response to the indication of the switch to the second listening point, wherein the at least one first audio object is part of a spatial audio content rendered to the user at the second listening point, wherein, in response to controlling the rendering of the audio based on the at least one signaling associated with at least the at least one first audio object, the spatial audio content rendered to the user at the second listening point is different from a spatial audio content based on a position and/or orientation of the user relative to the second listening point after the switch.

12. The method as in claim 11, wherein the at least one signaling associated with the at least one first audio object of the first listening point comprises a value corresponding to an amount of time playback of at least the at least one first audio object of the first listening point is to continue during and/or after the switch to the second listening point.

13. The method as in claim 11, wherein controlling the rendering of the audio comprises rendering at least one second audio object of the second listening point during and/or after the switch.

14. The method as in claim 11, wherein the at least one signaling links the at least one first audio object of the first listening point to at least one second audio object such that playback of the at least one second audio object is delayed based on the one or more conditions in the at least one signaling.

15. The method as in claim 14, wherein the playback of the at least one second audio object is delayed until after the rendering of the at least one first audio object of the first listening point is completed.

16. The method as in claim 11, wherein controlling the rendering of the audio comprises performing a crossfade between the at least one first audio object of the first listening point and a second audio object based on the at least one signaling.

17. The method as in claim 16, wherein the crossfade is performed after an amount of time indicated in the at least one signaling following the switch.

18. The method as in claim 11, wherein controlling the rendering of the audio comprises causing playback of at least one audio object of the second listening point to be prevented while the user remains at the second listening point based on the at least one signaling.

19. The method as in claim 11, wherein controlling the rendering of the audio in response to receiving the indication of the switch from the first listening point to the second listening point is further based on a current position and/or orientation of the user relative to the second listening point.

20. A non-transitory computer readable medium comprising program instructions for causing an apparatus to perform at least the following:

determining a first listening point in an audio space with which a position and/or orientation of a user is associated, wherein the audio space comprises at least the first listening point and a second listening point;

rendering audio associated with at least one first audio object of the first listening point based on the position and/or orientation of the user relative to the first listening point;

in response to receiving an indication of a switch from the first listening point to the second listening point, controlling the rendering of the audio based on at least one signaling associated with at least the at least one first audio object of the at least one first listening point, wherein the at least one signaling comprises one or more conditions for continuing playback of at least the at least one first audio object of the first listening point in response to the indication of the switch to the second listening point, wherein the at least one first audio object is part of a spatial audio content rendered to the user at the second listening point, wherein, in response to controlling the rendering of the audio based on the at least one signaling associated with at least the at least one first audio object, the spatial audio content rendered to the user at the second listening point is different from a spatial audio content based on a position and/or orientation of the user relative to the second listening point after the switch.

21. The apparatus of claim 1, where the first listening point and the second listening point are predetermined.

22. The apparatus as claimed in claim 1, wherein the at least one first audio object is not associated with the second listening point.

* * * * *